United States Patent [19]

Mandas et al.

[11] 3,998,309

[45] Dec. 21, 1976

[54] COIN ACCEPTING DEVICE

[75] Inventors: Peter J. Mandas, Sparks; Inge S. Telnaes, Reno, both of Nev.

[73] Assignee: Bally Manufacturing Corporation, Reno, Nev.

[22] Filed: Jan. 23, 1976

[21] Appl. No.: 651,844

[52] U.S. Cl. ..... 194/97 R; 194/102

[51] Int. Cl.[2] ..... G07F 3/02

[58] Field of Search ..... 194/1 E, 1 G, 97 R, 194/102, DIG. 1

[56] References Cited

UNITED STATES PATENTS

| | | | |
|---|---|---|---|
| 2,237,132 | 4/1941 | Christensen | 194/DIG. 1 |
| 2,539,855 | 1/1951 | Nelson | 194/97 R |
| 3,673,389 | 6/1972 | Kapsambelis et al. | 194/4 C X |
| 3,939,954 | 2/1976 | Collins | 194/102 |

FOREIGN PATENTS OR APPLICATIONS

| | | | |
|---|---|---|---|
| 1,168,850 | 10/1969 | United Kingdom | 194/97 R |

*Primary Examiner*—Robert B. Reeves
*Assistant Examiner*—Joseph J. Rolla
*Attorney, Agent, or Firm*—Gerald L. Moore

[57] ABSTRACT

A coin acceptor to prevent a cheating operation known as "stringing" wherein a coin is dropped into such an acceptor with a string attached and manipulated in a manner to make it appear that several coins have passed through the acceptor. This coin acceptor uses a series of coin position detectors with a counting circuit for sensing the sequence in which the coin passes the detectors.

11 Claims, 4 Drawing Figures

COIN ACCEPTING DEVICE

BACKGROUND OF THE INVENTION

In gaming devices such as slot machines there is incorporated a device commonly known as a coin acceptor which detects and signals the insertion into the device of the proper coin for activation of the gaming device. Usually such coin acceptors perform several functions. In the first instance, the acceptor must detect that a coin of the proper size and weight has been inserted. To be effective, the acceptor must also detect the passage of counterfeit coins commonly referred to as slugs. The slugs can be manufactured to the proper weight and size requirements but not have the silver content of a valid coin. After passing the above-identified tests, the coin usually is passed by a sensing mechanism which detects the passage of an accepted coin and activates the machine.

Such coin acceptors usually operate to reject any coin not meeting all the tests mentioned above. That is, the rejected coin is deflected and caused to pass through a different passage for return to the owner instead of passing through a good coin passage with the owner being credited for paying that amount.

Usually such an acceptor includes passages sized to accept coins no larger than a suitable coin, pivotable weight actuated levers which serve to deflect into a reject passage, coins of lesser weight than a suitable coin, and deflecting members which project each coin at an angle to the original path in a manner such that coins having characteristics other than a suitable coin will not pass through the accepted passageway. In addition magnetic means are usually employed to detect slugs not having the silver content of a suitable coin.

Thus the primary purpose of a coin acceptor is to conduct various tests on the coin inserted into the machine to detect whether a proper coin is being offered for activation of the device. The rejected coins are usually deflected into a reject passage and returned to the owner. Sometimes in the case of slugs or counterfeit coins, the coin is actually retained in the acceptor and not returned to the owner.

There now exist several types of gaming and dispensing machines which call for the insertion of a plurality of suitable coins. In such gaming devices, the player can either increase the odds of winning or the amount paid off with winning by inserting multiple coins of the same type. Naturally each of these coins are passed in serial order through a coin acceptor having the capability of conducting the various tests previously described with a counter noting the passage of each suitable coin. In the past, the counter has usually comprised a microswitch having a lever arm which is tripped by the passage of a coin through an accepted coin passage. Thus a player can insert any number of coins up to a maximum number prior to actually playing the machine. Also, a plurality of similar coins must be inserted into some dispensing machines in which the cost of an item is a multiple whole number of the value of one suitable coin.

With the advent of such multiple coin machines, there has arisen the method of cheating the coin acceptor commonly referred to as "stringing". Generally stringing comprises the procedure of fastening to a suitable coin a string or thread. The string is lighweight and has no noticeable effect on the passage of the coin through the coin acceptor. Naturally the coin acceptor will pass the coin through the accepted coin passage because the coin is suitable for acceptance and meets all the tests.

Subsequently the coin passes the counter which as stated before, has in the past, been a microswitch having a lever extending into the accepted coin passage. The lever will be tripped once by passage of the coin. In the normal operation of the coin acceptor, the passage of several coins in succession will activate the machine in the normal manner.

However with the stringing procedure, once the accepted coin has passed through the accepted coin passageway a sufficient distance to trip the microswitch, it is moved back past the switch trip mechanism by pulling on the string a very short distance and then allowed to pass once again past the trip lever. Thus the coin acceptor indicates the passage of several suitable coins past the trip lever when in fact only one suitable coin has been inserted and is being held in the coin acceptor. It is the primary purpose of this invention to provide a coin detector which prevents the cheating procedure known as stringing.

SUMMARY OF THE INVENTION

A detector for sensing the passage of a coin comprising three sensors spaced at predetermined intervals along the path of the coin in combination with circuit means for sensing the presence of the coin at each sensor position, for detecting the order at which the coins arrive at each sensor position, for indicating the uninterrupted passage of the coins past the sensor positions and for indicating any reversal in the direction of travel of the coins thereby indicating any irregular movement of the coin through the device.

DESCRIPTION OF THE INVENTION

Figure 1:
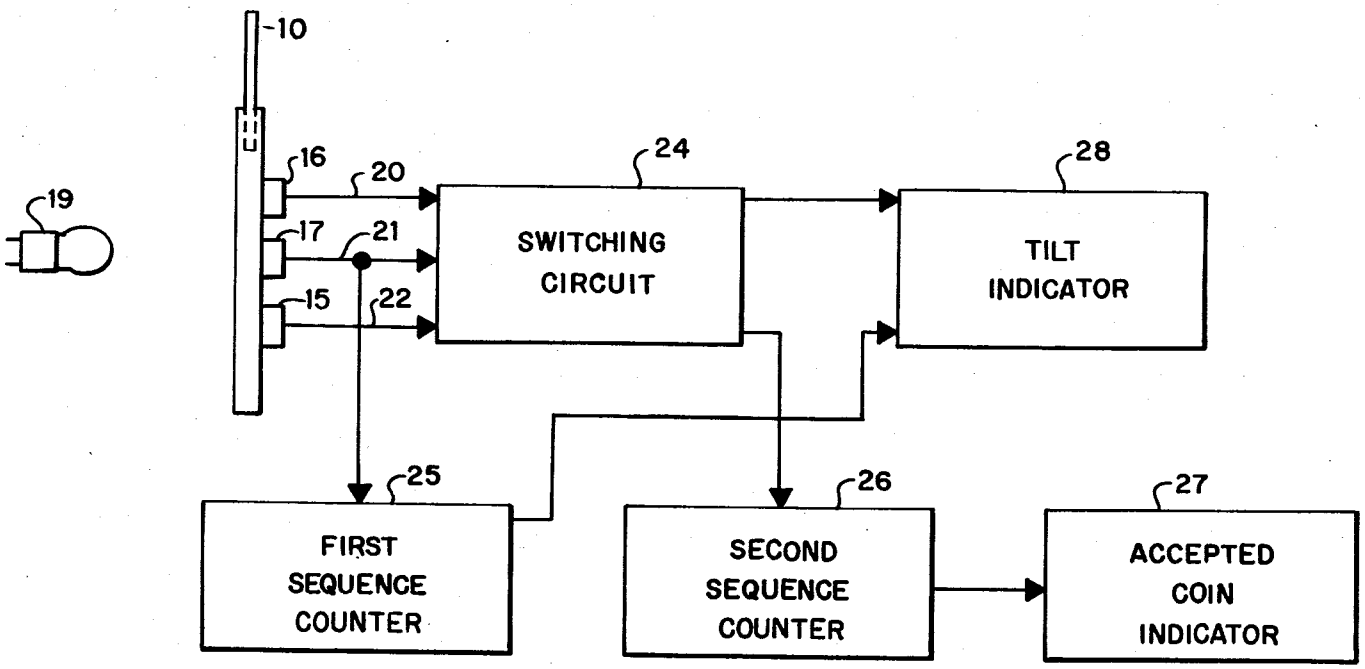
FIG. 1 shows one embodiment of the invention in block diagram form.
Figure 1A:
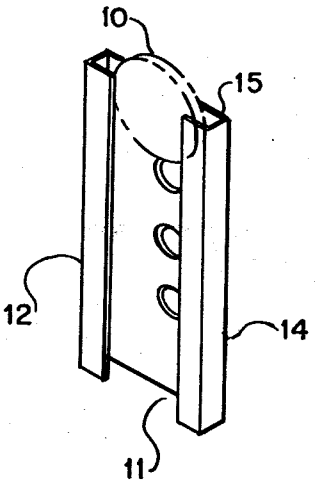
FIG. 1A is a perspective view of the coin passage.

As illustrated in the drawings, the invention is used to determine the proper movement of a coin 10 as it passes through a passage 11 formed by the edge walls 12 and 14 and a side wall 15. As discussed previously, the coin has already been passed through a device which determines the acceptability of the coin. Such devices are well known and generally comprise passages, levers and magnetic means for determining the size, weight and silver content of the coin for making a determination as to whether the coin meets all the specifications of an acceptable coin. Thereafter passage of the coin must be detected such that a signal can be generated for energizing the associated apparatus or device such as a slot machine (not shown). As described before, there has existed the method of cheating known as stringing whereby coins are pulled back through the indicating mechanism after passage through the coin-accepting mechanism and thereafter permitted to once again pass through the indicating mechanism to be counted as a second coin. Naturally such a sequence can be carried out many times by proper manipulation of a single coin.

In accordance with the present invention, there is provided a detector which both detects the passage of a coin therethrough and also indicates any irregular or abnormal movement of the coin such as a reversal in direction of movement, which irregular movement would be necessary to effect the stringing method of cheating.

In accordance with the invention, there is provided a series of detectors spaced along the passage through which the accepted coin is passed, which detectors sense the arrival of the coin at that point and also sense the passage of the coin past that point. Associated with the detectors are means including various switching and counter circuits which react to the arrival and passage of the coin past the various detectors. In this manner the passage of the coin in a predetermined manner past the detector causes a signal to be generated indicating acceptance of the coin.

As shown in FIG. 1, the detectors are in the form of light detecting diodes 16, 17 and 18 positioned to receive light through openings in the side wall 15 of the coin passage from a light source or lamp 19. This lamp is constantly energized and the light striking the diodes is interrupted by passage of a coin along the passage 11. Thereafter means are provided to react to the various signals resulting from the shadowing of the diodes to signal an "accepted coin" if the sequence is normal, or to signal "tilt" if the coin travel is abnormal. While one embodiment is shown and described herein for serving as means for reacting to the diode signals, several other embodiments are also feasible. For instance, the diode signals can be fed to a programmed computer or other microprocessor adapted to detect the sequence of the diode signal changes and indicate the normal or abnormal travel of the coin.

Thus as each of the diodes is shadowed by the coin the signal passing through the conductors 20, 21 and 22 to a switching circuit 24 is altered to cause operation of that switching circuit. The switching circuit and the signals from the detectors are used to trigger a first sequence counter 25 and a second sequence counter 26 in the proper order such that a signal will be transmitted to the accepted coin indicator terminal 27 when the coin has passed through the passage 11 in the proper manner. Thus with a signal at terminal 27, any associated coin operated device (not shown) will be caused to react to a tilt indication and usually will be automatically locked until inspected by an attendant. Any interruption of the coin travel will result in a signal being transmitted to a tilt indicator 28 which in turn will trigger the associating mechanism so as to cause an indication that an irregularity in the coin travel has occurred. For instance, in the usual slot machine a tilt indication will be signaled, thereby stopping the operation of the machine until a reset condition is triggered.

In this circuit, the switching circuit 24 is shown as a PROM circuit No. 74188, the first and second sequence counters are both synchronous up/down counters No. 74193. All these circuit components are made by the Texas Instrument Corporation and are standard commercial products. The purpose of the circuit is to determine the uninterrupted passage of a coin through the passage 11. The circuit reacts to the change in signal level caused by the shadowing of the diodes 16, 17 and 18 and transmitted through the conductors 20, 21 and 22. The circuit shown is properly actuated to cause an indication of an accepted coin when the first sequence counter has been pulsed once and the second sequence counter has been pulsed twice. Pulsing of either counter over these counts will result in a tilt indication and not pulsing both counters these counts will not render an accepted coin signal. The following is a sequence of signal level changes in the circuit caused by the sequence of shadowing and uncovering of the light detection diodes as the coin passes downward along the passage 11. The sequence starts with the coin initiating travel through the passage prior to the time the first diode 16 is encountered. All operations in which the coin travel direction is reversed are marked by an asterisk (*) to indicate an attempt at stringing the acceptor.

Figure 2:
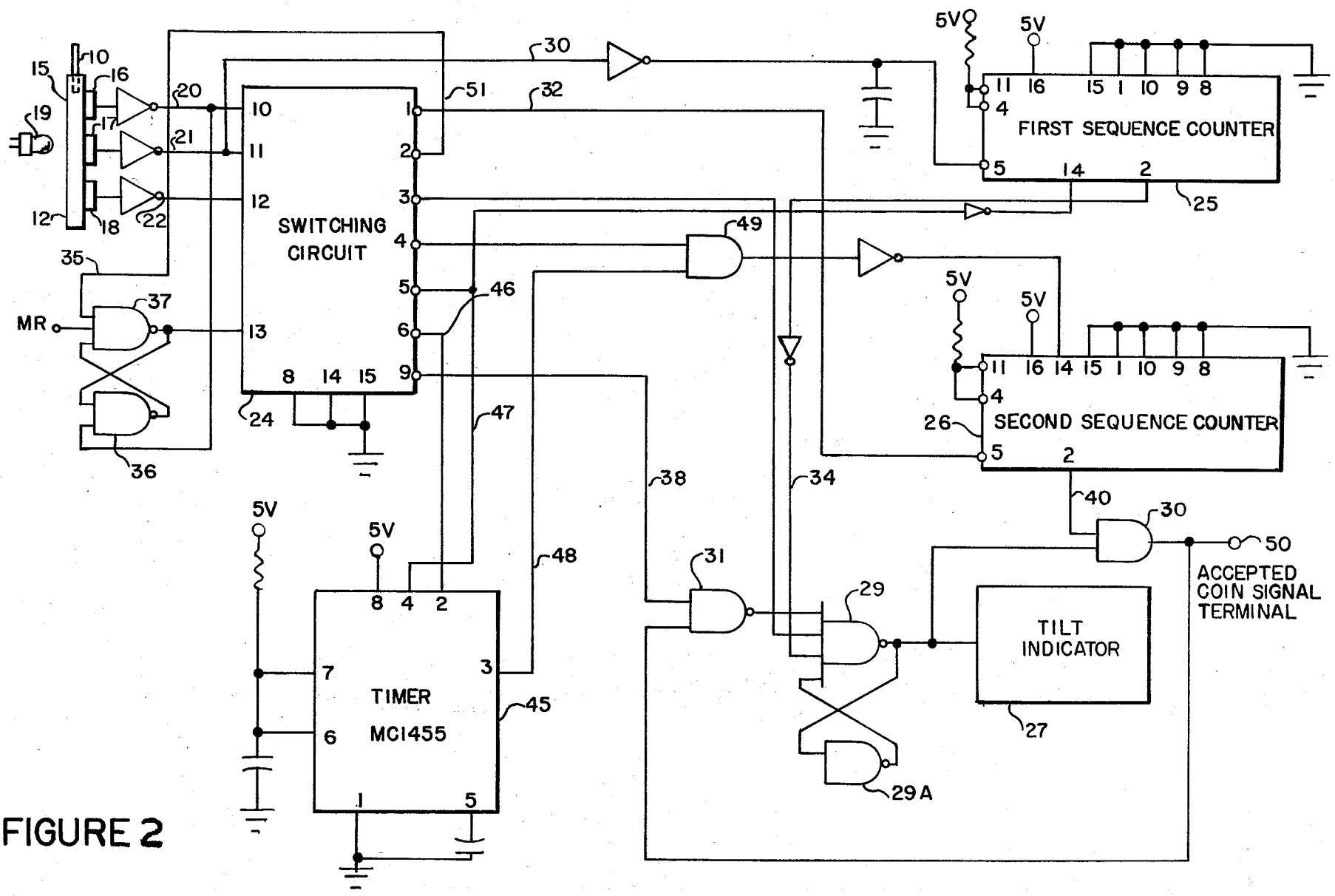
FIG. 2 is a circuit diagram of the invention shown in FIG. 1.
Figure 3:
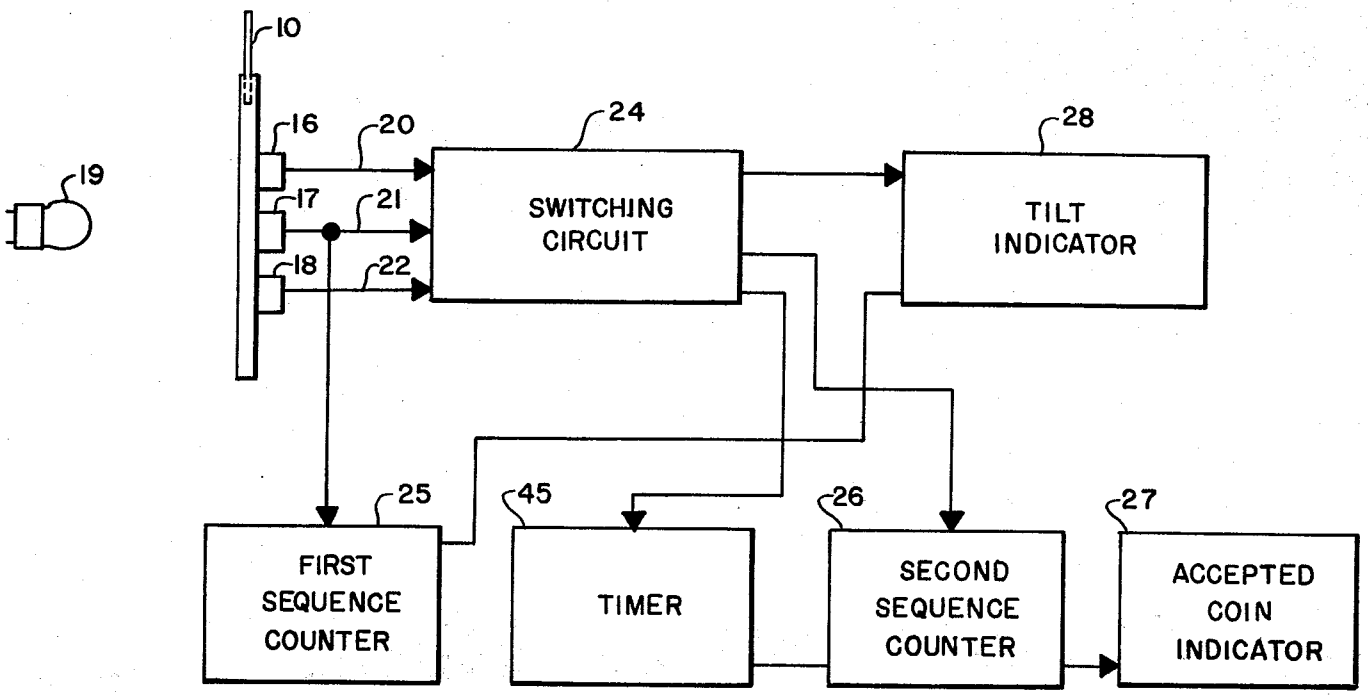
FIG. 3 is a block diagram of a second embodiment of the invention.

Operation of Circuit of FIG. 2

A. EVENT — Coin enters acceptor and shadows diode 16.
RESULT — Signal on conductor 20 goes to higher level. Switching circuit 24 is set and Terminal 9 thereof goes to 1 or high signal level.

*B. EVENT — Diode 16 uncovered by attempt to pull coin back out after Event A, as a result the signal on conductor 20 falls.
RESULT — Potential of terminal 10 of the switching circuit 24 falls.
Signal on the terminal 13 of circuit 24 returns to one which disables circuit 24.

C. EVENT — Coin falls further to shadow both diodes 17 and 16.
RESULT — The signal in conductor 21 goes high.

D. EVENT — After Event C, coin is pulled back to uncover diode 17.
RESULT — On the leading edge of diode 17 signal, sequence counter 25 will show a counter of 1. On trailing edge of diode 17 signal, sequence counter 26 will show a count of 1. Also terminal 9 of switching circuit 24 is set to 1 (high level).

E. EVENT — Coin again is caused to advance to cover diodes 16 and 17 after diode 17 is uncovered in Event D. Signal level on conductor 21 rises.
RESULT — On the switching circuit 24 the terminal 1 is set to 1. Terminal 9 of switching circuit 24 remains at a 1 (high level). The leading edge of diode 17 will set sequence counter 25 to a count of 2 which will set circuit 29 to give a tilt indication and any associated coin apparatus will be stopped from functioning until reset. No other coins will be accepted.

*F. EVENT — The coin is withdrawn to uncover diode 17 after Event E, conductor 21 signal goes to lower value.
RESULT — Circuit 24 is reset to initial setting as if no coin had been inserted.

*G. EVENT — Diode 17 is recovered after Event F and the signal on the conductor 21 goes high.
RESULT — Circuit 24 is reset to initial setting.

*H. EVENT — Uncover both diodes 16 and 17 after Event G by pulling coin back out of acceptor.
RESULT — The switching circuit 24 is reset to zero as if no coin had been inserted.

I. EVENT — Coin is moved to cover diode 18 after covering the diodes 16 and 17 in Event D and without any withdrawal of the coin.
RESULT — The terminal 1 of the switching circuit 24 goes to zero causing the signal at the terminal 5 of the second sequence counter 26 to go high but not to pulse the timer since the timer pulses only on the trailing edge of a rise in signal.

The terminal 9 of the switching circuit 24 goes high.

J. EVENT — The coin is removed sufficiently to uncover the diode 18 after Event I.

RESULT — The terminal 9 stays high therefore no result.

K. EVENT — The coin is moved to recover diode 18 after Event J. Terminal 1 goes low.

Second sequence counter 26 is pulsed second time.

Terminal 2 of the second sequence counter switches to one therefore AND gate 30 transmits a signal to NAND gate 31 which in combination with the signal from terminal 9 of switching circuit 24 transmits signal through NAND gates 31 and 29 to energize tilt indicator 28.

L. EVENT — The coin moved further to uncover diode 16 after Event I. With normal movement of coin forward and no reversal of direction, no change occurs in the circuit.

*M. EVENT — The coin direction is reversed to again cover diode 16 after Event L.

RESULT — Terminal 1 of the switching circuit 24 goes to a lower potential to pulse the second sequence counter 26 thereby causing terminal 2 of the second sequence counter to go high thereby triggering the AND gate 30, the NAND gate 31 and the NAND gate 29 to energize the tilt indicator 28.

N. EVENT — The coin moved forward to uncover diode 17 leafing only diode 18 covered after Event L.

RESULT — The terminal 1 of switching circuit 24 goes to lower potential causing a trailing edge triggering of the second sequence counter 26 through the terminal 5 and conductor 32. The second sequence counter terminal 2 goes high triggering the AND gate 30 to energize the accepted coin indicator 50.

O. EVENT — Coin is now pulled back to again cover diode 17 as well as 18 after Event N.

RESULT — The leading edge of the raised signal on conductor 21 as transmitted through conductor 30 causes the first sequence counter 25 to pulse a second time resulting in a change in the potential of terminal 2 of that circuit. This change in potential is transmitted through the conductor 34 to the NAND gate 29, causing a tilt indication on the indicator 28.

P. EVENT — Coin is permitted to go forward in the normal manner uncovering the diode 18 after Event N.

RESULT — The signal transmitted through the conductor 51 causes the NAND gate 36 and the NAND gate 37 to trigger the switching circuit 24 at the terminal 13, resetting the switching circuit to receive a new coin.

*Q. EVENT — The coin now pulled back to cover diode 18 after Event P.

RESULT — The raised signal on conductor 22 as transmitted to the switching circuit through the terminal 12 causes a low level of the potential of terminal 3 of the switching circuit which is conducted through the conductor 38 to cause the NAND gate 29 to energize the tilt indicator 28, resulting in a tilt indication.

SUMMARY OF OPERATION

Thus as seen from the foregoing, if the coin is passed through the channel 11 in an uninterrupted manner and not reversed in direction, the sequential sensing of the coin position by the diodes 16, 17 and 18 will result in a pulsing of the first sequence counter 25 one count and the second sequence counter 26 two counts. Such pulsing will result in the satisfactory voltage levels on the conductors 34 and 40 to trigger the circuit in a manner to energize the accepted coin terminal 50. Thus the device associated with the acceptor is signaled that an acceptable coin has passed through the mechanism so the device can react in the usual manner of having received such payment.

However as seen from the resulting action after those steps marked by an asterisk in the operational sequence above, any attempt to reverse the direction of movement of the coin in a manner to cause passage of the coin through the sensor a second time will result in a tilt indication because of the triggering of the counters. Thus any attempt to pass the same coin through the sensor more than once will render a tilt indication in the sensing apparatus.

In accordance with another feature of the invention, there can be provided an added safeguard against stringing by the addition of a timer 45 as shown in FIG. 2. The overall purpose of this timer is to assure that only a minimum time differential can occur between the entrance and exit of the coin through the detector.

In the normal sequence of events the coin is allowed to fall through the passage 11 and shadow the diodes sequentially in the time differential that it takes the coin to fall primarily under the influence of gravity. Naturally the coin passes quite quickly and in fact can pass completely through the passage shown for illustration purposes in a time period approaching 40 milliseconds. Thus as an additional safeguard there can be added a circuit comprising a timer 45 which timing sequence is initiated with arrival of the coin at the diode 16, such that the coin must shadow the diode 18 prior to the timing out of the timer. Thus the timer can be set for a period of time somewhat greater than the time it takes for the coin to pass from the diode 16 to the diode 18 to allow for any change in the speed of the coin which might occur naturally even though the coin is acceptable and yet make it impossible for the coin to be manually moved within the sensor within that time period. For this purpose a timer having a 70 millisecond timing period is used in this illustration thereby requiring that the diodes 16, 17 and 18 be shadowed and unshadowed sequentially within the 70 millisecond period.

In operation this timer is initiated by the shadowing of the diode 16 causing a raising of the signal in the conductor 20 as occurs at Event A. This signal is transmitted to the switching circuit 24 causing a rise in the potential of the terminal 6 thereof. Such change in potential is transmitted through the conductor 41 to the terminal 2 of the timer 45 initiating the timing action thereof.

With the subsequent uncovering of the diode 18 at Event I, thereby triggering the switching circuit 24, a change in potential is sensed at the terminal 5 of the switching circuit, which is transmitted through the conductor 47 to the terminal 4 of the timer 45. The receipt of this signal resets the timer. However if such signal is not received at the terminal 4 within the 70 millisecond time period, or whatever time period is selected for the timer depending upon the application of the sensor, there will be transmitted from the terminal 3 of the timer 45 and through the conductor 48 to the AND gate 49 a signal which is received at terminal 14 of the sequence counter 26. This action will reset sequence counter 26 and no coin will be accepted. In this manner an additional safeguard is provided in the circuit requiring the sequential shadowing of the diodes by passage of the coin within a very short period of time. If a player is attempting to manipulate the diodes in any manner, he cannot react within this short period of time to string the sensor even if he attempts to use multiple coins all on separate strings.

Thus there has been described and illustrated one embodiment of a coin accepting device for detecting the mode of passage of a coin along a predetermined path. Naturally some elements of the invention described can be altered and still be within the scope of the invention. For instance, the number of sensors can be increased to diminish further the chances of the acceptor being tripped by stringing, the type of sensors can be changed and the switching circuits can be altered to indicate in greater detail the actual mode of passage of the coin. Also the means for switching can be of different type suitable for acting in response to the sensor signals.

The invention claimed is:

1. A detector for sensing the passage of a coin having a leading and a trailing edge along a predetermined path, comprising, in combination, a plurality of sensors spaced along the path with each sensor including signal generating means for indicating the arrival of the leading edge of the coin at the sensor position and passage of the trailing edge of the coin past that sensor position;

means for transmitting said sensor signals in sequence;

means acting in response to the occurrence of said signals for indicating the uninterrupted passage of the coin past the sensors when the signals are in one predetermined sequence; and means for indicating the interrupted passage of the coin past the sensors when the signals are in a second sequence.

2. A detector as defined in claim 1 including timing means for comparing the travel time differential between the arrival of the coin at the first sensor and the passage of the coin past the last sensor spaced along the predetermined path and a preselected time differential, and including means for signaling when the travel time differential exceeds the preselected time differential.

3. A detector as defined in claim 1 wherein said plurality of sensors includes three sensors equally spaced along the predetermined path.

4. A detector as defined in claim 3 wherein said sensors are spaced such that the coin leading edge will arrive at the next sensor position prior to passage of the trailing edge of that coin past the next preceding sensor.

5. A detector as defined in claim 3 wherein said sensors include a plurality of light detectors in combination with a light source positioned on the opposite side of the predetermined path from the detectors such that passage of the coin between each detector and light source will prevent light from reaching each detector and each detector will generate an electrical signal indicating alignment of the coin between the detector and light source.

6. A detector for sensing the passage of a coin having a leading edge and a trailing edge along a predetermined path, comprising, in combination, a plurality of sensors each spaced along the path with each sensor including means for generating signals indicating the arrival of the leading edge of the coin at the sensor and thereafter the passage of a trailing edge of the coin therepast;

switching means receiving said sensor signals in sequence and for closing a first circuit when the sequence of said sensor signals is in one predetermined order indicating the uninterrupted passage of the coin past the sensors and for closing a second circuit when the sensor signals are not in said predetermined order indicating the interrupted passage of the coin past the sensors;

first indicating means acting in response to the closing of the first circuit for signaling the passage of a coin past the sensors in an uninterrupted manner; and a second indicating means acting in response to the closing of the second circuit for signaling the passage of a coin past the sensors in an interrupted manner.

7. A detector as defined in claim 6 wherein said plurality of sensors includes three sensors spaced from each other along said predetermined path.

8. A detector as defined in claim 7 wherein said sensors each comprise a light detector positioned to one side of said predetermined path in combination with a light source positioned on the other side of said path.

9. A detector as defined in claim 8 wherein said sensors are spaced apart a distance such that the trailing edge of a coin will pass a preceding sensor before the coin leading edge passes the succeeding sensor.

10. A detector for sensing the passage of a coin along a predetermined path, comprising, in combination, a plurality of sensors positioned along the predetermined path, each sensor including means for signaling the alignment of a portion of the coin with that sensor;

a plurality of switches electrically connected to be actuated in succession upon the receipt of a sequence of said sensor signals, said switches being connected to close a first circuit when the signal sequence is in a first order and being connected to close a second circuit when the signal sequence is in a second order; and indicating means for signaling the closing of one of said first and second circuits thereby indicating the sequence in which a coin aligns with said sensors.

11. A detector as defined in claim 10 including means for indicating when the time duration between the coin alignment with the first sensor it aligns with and the last sensor it aligns with exceeds a predetermined time period.

* * * * *